US011460168B2

(12) United States Patent
Huang et al.

(10) Patent No.: US 11,460,168 B2
(45) Date of Patent: Oct. 4, 2022

(54) LAMP

(71) Applicants: RADIANT OPTO-ELECTRONICS (SUZHOU) CO., LTD., Wujiang Jiangsu (CN); Radiant Opto-Electronics Corporation, Kaohsiung (TW)

(72) Inventors: Guo-Hao Huang, Kaohsiung (TW); Chung-Kuang Chen, Kaohsiung (TW); Chun-Yi Sun, Kaohsiung (TW)

(73) Assignees: RADIANT OPTO ELECTRONICS (SUZHOU) CO., LTD., Wujiang Jiangsu (CN); RADIANT OPTO ELECTRONICS CORPORATION, Kaohsiung (TW)

( * ) Notice: Subject to any disclaimer, the term of this patent is extended or adjusted under 35 U.S.C. 154(b) by 0 days.

(21) Appl. No.: 17/479,711

(22) Filed: Sep. 20, 2021

(65) Prior Publication Data

US 2022/0113001 A1 Apr. 14, 2022

Related U.S. Application Data

(63) Continuation of application No. PCT/CN2020/119998, filed on Oct. 9, 2020.

(51) Int. Cl.

| | |
|---|---|
| ***F21V 3/06*** | (2018.01) |
| ***F21V 1/14*** | (2006.01) |
| ***F21V 17/10*** | (2006.01) |
| *F21Y 105/18* | (2016.01) |

(52) U.S. Cl.

CPC ..... *F21V 3/06* (2018.02); *F21V 1/143* (2013.01); *F21V 17/104* (2013.01); *F21V 17/105* (2013.01); *F21Y 2105/18* (2016.08)

(58) Field of Classification Search

CPC ... F21V 1/20; F21V 1/22; F21V 3/061; F21V 3/0615; F21V 5/046; F21V 17/104; F21V 17/105; F21V 21/02; F21S 8/04–068; F21Y 2105/18

See application file for complete search history.

(56) References Cited

U.S. PATENT DOCUMENTS

| | | | | |
|---|---|---|---|---|
| 10,330,902 | B1 | 6/2019 | Marcoux | |
| 2015/0109778 | A1* | 4/2015 | Yokotani | F21V 17/12 362/235 |
| 2021/0356097 | A1* | 11/2021 | Vernier | F21V 5/043 |

FOREIGN PATENT DOCUMENTS

| | | | |
|---|---|---|---|
| CN | 201351865 | Y | 11/2009 |
| CN | 201434255 | Y | 3/2010 |
| CN | 202284732 | U | 6/2012 |

(Continued)

*Primary Examiner* — Sean P Gramling

(74) *Attorney, Agent, or Firm* — Muncy, Geissler, Olds & Lowe, P.C.

(57) ABSTRACT

A lamp includes a lamp holder, a lampshade combined with the lamp holder, and at least one diffuser. The lamp holder includes a base, a circuit board arranged on the base, and a plurality of light-emitting elements arranged on the circuit board. The diffuser is used to cover the light-emitting elements, and a sufficient distance between the diffuser and the light-emitting elements is maintained so that the light of the light-emitting elements are diffused uniformly, which can reduce the light spots caused by the special shape of the lampshade or the excessive distance between the light-emitting elements and improve the light uniformity of the lamp.

15 Claims, 10 Drawing Sheets

(56) References Cited

FOREIGN PATENT DOCUMENTS

| | | | |
|---|---|---|---|
| CN | 103574358 | A | 2/2014 |
| CN | 103629624 | A | 3/2014 |
| CN | 203880490 | U | 10/2014 |
| CN | 206018313 | U | 3/2017 |
| CN | 206563243 | U | 10/2017 |
| CN | 208058432 | U | 11/2018 |

* cited by examiner

LAMP

RELATED APPLICATIONS

This application claims priority of a continuation application of International Application No. PCT/CN2020/119998, filed on Oct. 9, 2020. The entire disclosures of all the above applications are hereby incorporated by reference.

BACKGROUND OF THE INVENTION

1. Field of the Invention

The present invention relates to a lamp, and in particular, to a lamp with uniform light.

2. Description of the Prior Art

With the advantages of high lumen efficiency, low energy consumption, high reliability and long life, LED is gradually being used in daily lighting fixtures. However, LED usually has the characteristics of strong light intensity at the central viewing angle and weaker light intensity at the surrounding viewing angle. When LEDs are used in lighting fixtures, it is easily occurred uneven spots or glare as the light passes through the lampshade, which has adverse effect on the comfort of use.

SUMMARY OF THE INVENTION

One object of the present invention is to provide a lamp with uniform light.

The lamp includes a lamp holder, a lampshade combined with the lamp holder, and at least one diffuser. The lamp holder includes a base, a circuit board arranged on the base, and at least one light-emitting element arranged on the circuit board. The lampshade includes a light incident portion, and the at least one light-emitting element projects light toward the light incident portion. The at least one diffuser covers the at least one light-emitting element.

The features of the present invention is that the diffuser is used to cover the light-emitting element, and a sufficient distance is maintained between the diffuser and the light-emitting element so that the light of the light-emitting element is diffused uniformly, which can reduce uneven light spots or glare effectively and improve the uniformity of light of the lamp.

DETAILED DESCRIPTION OF THE PREFERRED EMBODIMENTS

The making and using of the embodiments of the lamp are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Figure 1:
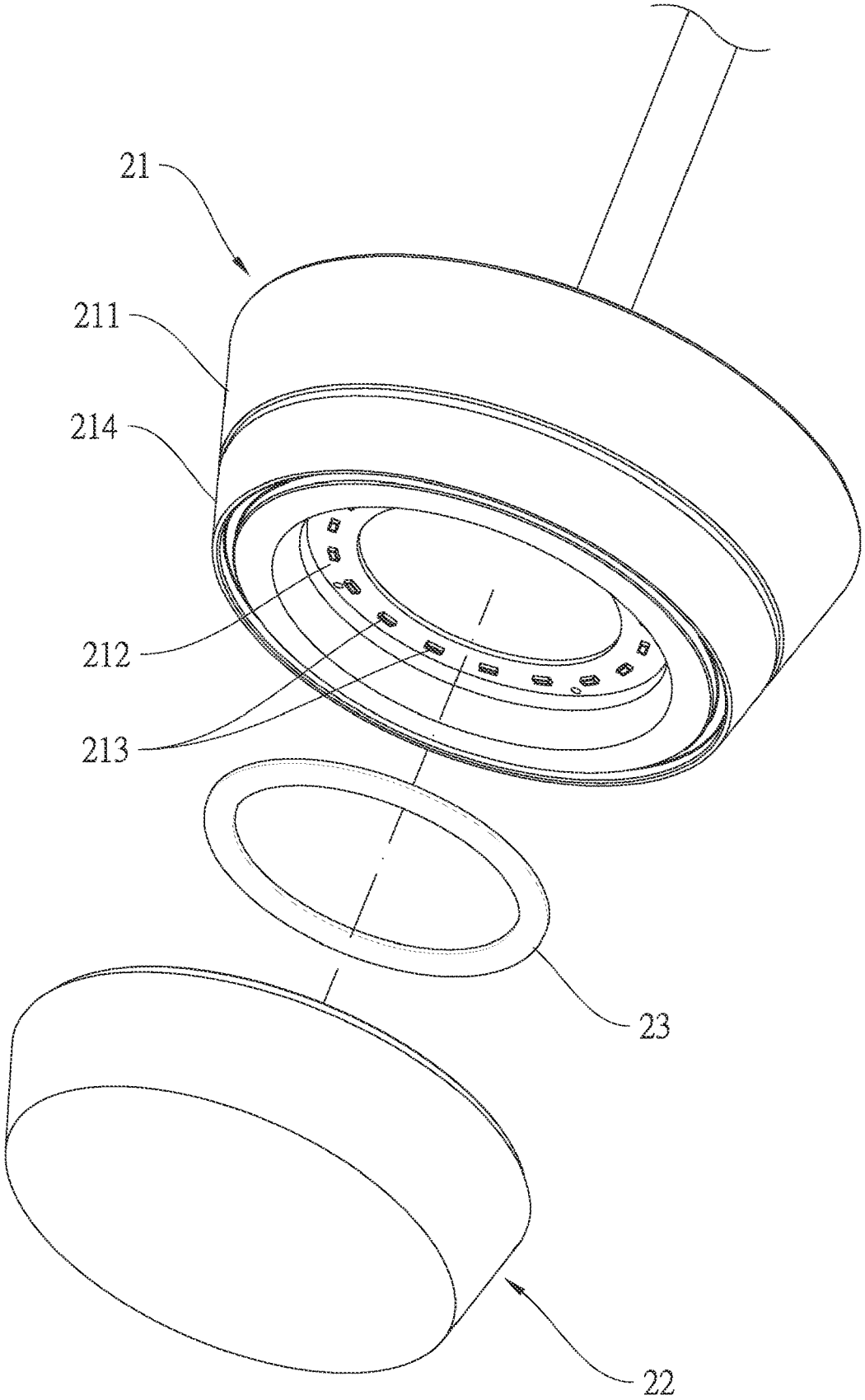
FIG. 1 is a three-dimensional exploded view of a lamp according to a first embodiment of this invention.
Figure 2:
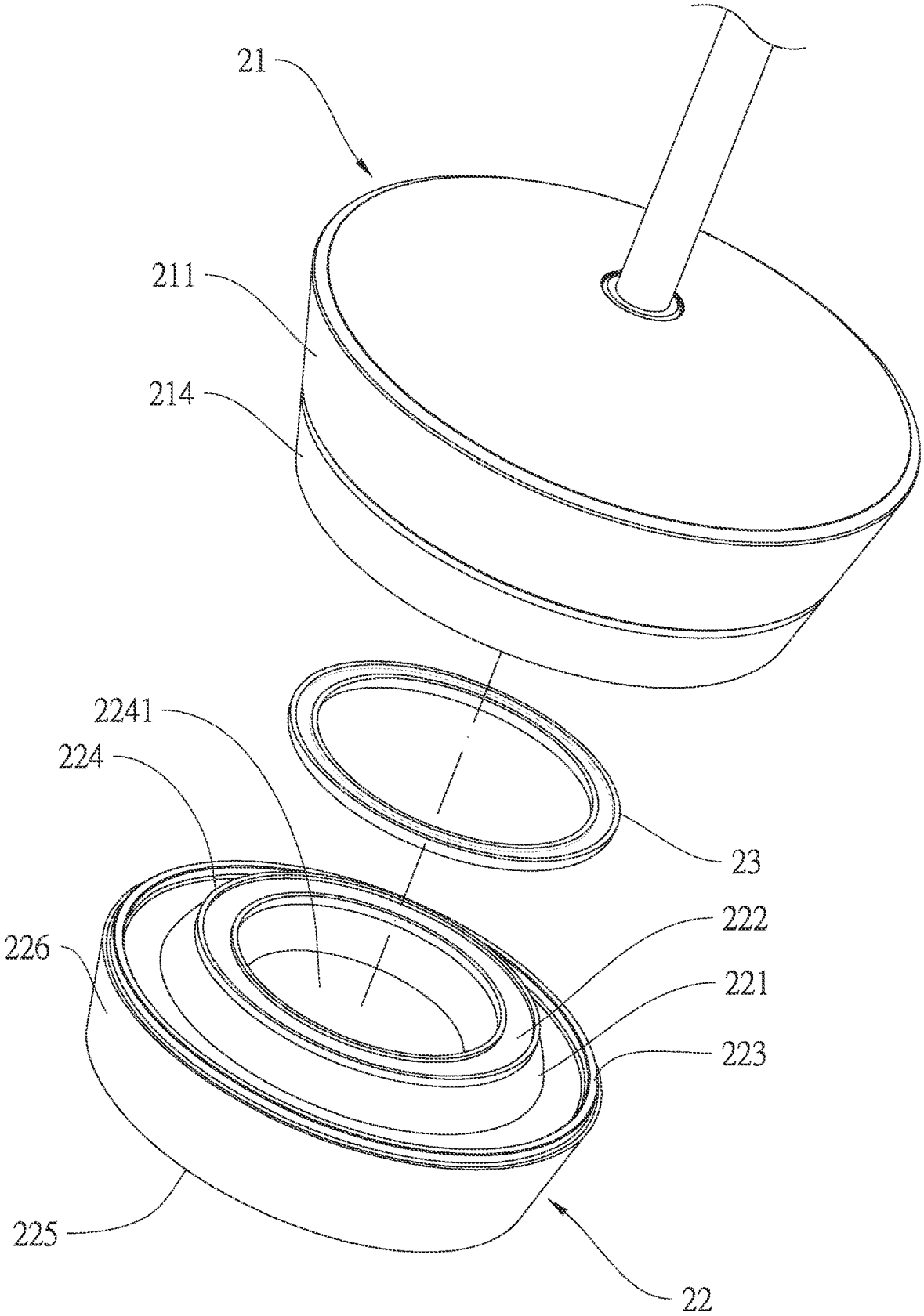
FIG. 2 is a three-dimensional exploded view according to the first embodiment from another angle.

Referring to FIG. 1 and FIG. 2, the first preferred embodiment of the lamp of the present invention includes a lamp holder 21, a lampshade 22 combined with the lamp holder 21, and a diffuser 23. In this embodiment, the lamp holder 21 and the lampshade 22 can be combined by hooks, screws, pasting, or magnetic attraction, but not limited to this, as long as the two of them can be combined firmly and not easy to fall off. The lamp holder 21 includes a base 211, a circuit board 212 arranged on the base 211, and a plurality of light-emitting elements 213 arranged on the circuit board 212 at intervals, wherein the diffuser 23 covers the light-emitting elements 213. It should be noted that, the lamp of the present invention is drawn in the form of a pendent lamp as an example, and the lampshade 22 can be a transparent design, but it is not limited to this. In this embodiment, the lampshade 22 can be made of transparent or any material with transmittance. When the lampshade 22 is made of transparent material, it has a better visual perception showing crystally clear effect as the light emitted by the light-emitting elements 213 is transmitted through the lampshade 22.

Figure 3:
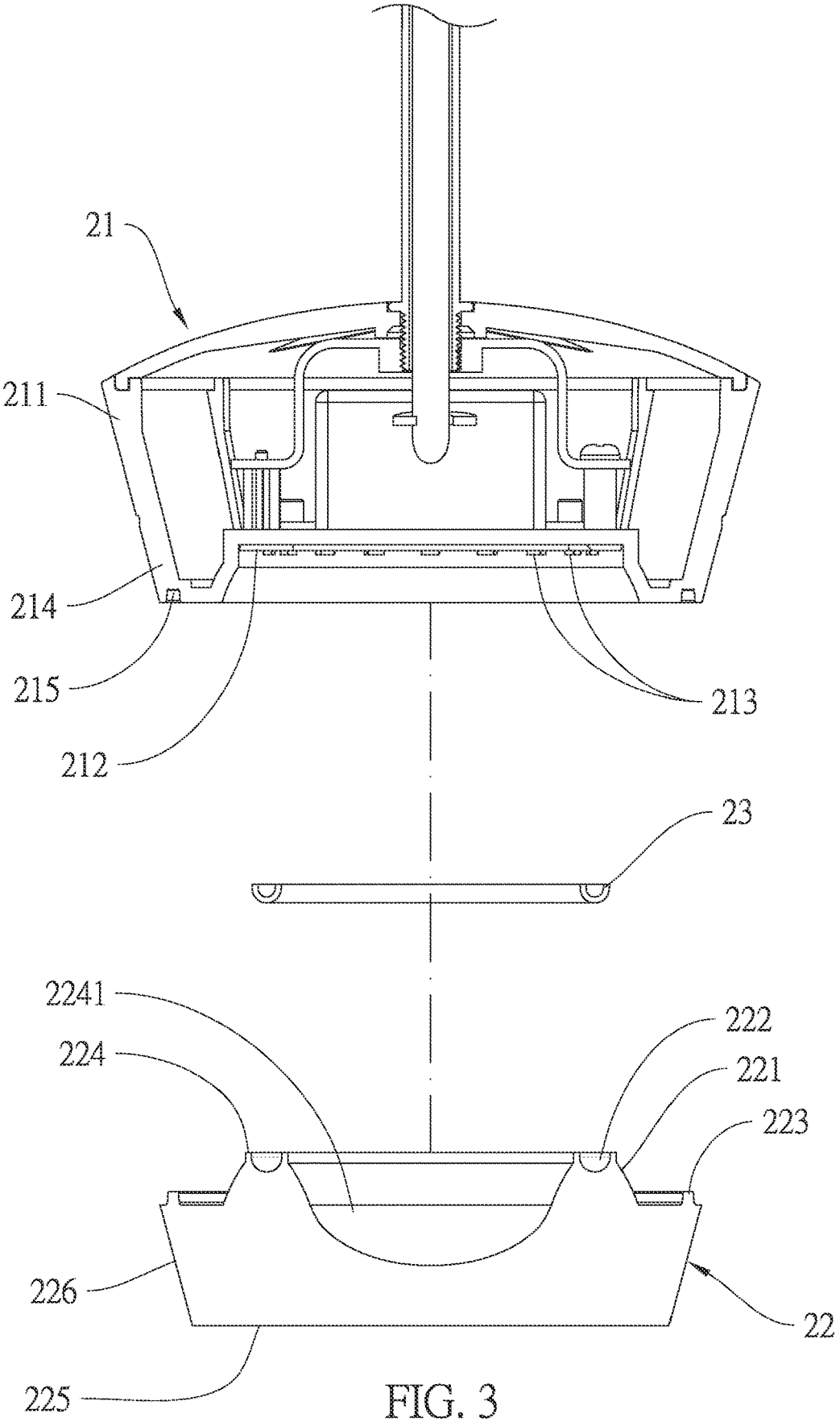
FIG. 3 is a exploded view according to the first embodiment from another angle.

Referring to FIG. 2 and FIG. 3, the lampshade 22 includes a light incident portion 221, the light incident portion 221 has a accommodating groove 222 for receiving the light-emitting elements 213, and the light-emitting elements 213 is disposed in the accommodating groove 222. It should be particularly noted that, in this embodiment, the diffuser 23 is an independent element, the accommodating groove 222 is an annular groove, and the diffuser 23 is an annular curved surface structure that matches the shape of the accommodating groove 222. Therefore, the diffuser 23 is placed in the accommodating groove 222 and located between the light incident portion 221 and the light-emitting elements 213. In another embodiment, the diffuser 23 may be wrapped in the lampshade 22 via the injection molding of the lampshade 22 and is set close to a front side of the light incident portion 221. In another embodiment, the diffuser 23 is a frosted structure or a hairline structure formed directly on the surface of the lampshade 22 which is facing the light-emitting elements 213. Whether the formation of the diffuser 23 mentioned above, the light emitted by the light-emitting elements 213 must pass through the diffuser 23 before entering the lampshade 22 to achieve the purpose of diffusion. On the other hand, the diffuser 23 is not in contact with the light-emitting elements 213, so as to prevent the bright spots of the LED from being seen directly from the external appearance, and maintain the comfort when looking directly at the lamp of this invention.

It should be noted that since the diffuser 23 is an independent element, it is convenient to provide lamps with the diffusers 23 with different color or shading degrees for replacement to meet customer's requires. It also has the benefit of reducing the cost of stocking and improving the efficiency of assembly.

Referring to FIG. 3, the base 211 of the lamp holder 21 has a annular wall area 214 surrounding the circuit board 212 and relative protruding from the circuit board 212, and a first limiting member 215 disposed on the annular wall area 214. The lampshade 22 further has a second limiting member 223 corresponding to the first limiting member 215. In this embodiment, as shown in FIG. 3, the second limiting member 223 is disposed outer of the light incident portion 221. In other embodiments, the second limiting member 223 could be provided at an inner position relative to the light incident portion 221 of the lampshade 22, and the portion of the lamp holder 21 corresponding to the second limiting member 223 forms the first limiting member 215, as long as the positioning effect between the lamp holder 21 and the lampshade 22 can be achieved, the structures and the positons of the first limiting member 215 and the second limiting member 223 are not limited to the positioning manner mentioned above.

Referring to FIG. 2 and FIG. 3, the lampshade 22 is a light guide element and has a first end surface 224, a second end surface 225 opposite to the first end surface 224, and a side surface 226 located between the first end surface 224 and the second end surface 225. The light incident portion 221 is located on the first end surface 224, and light enters the lampshade 22 from the light incident portion 221 on the first end surface 224 and is transmitted to the second end surface 225 and the side surface 226 to emit light. It should be particularly noted that the first end surface 224 has a groove 2241 extending toward the second end surface 225, and the accommodating groove 222 is arranged around the groove 2241. In this way, it can be ensured that when the light of the light emitting elements 213 emitted toward the light incident portion 221, the light will emit uniformly toward the second end surface 225 inside the lampshade 22. In addition, the groove 2241 may be a blind hole as shown in FIG. 3, and the second end surface 225 may form a continuous light-emitting surface with a larger light-emitting area. The groove 2241 can also be a through hole extending from the first end surface 224 to the second end surface 225, and the manufacturing cost is lower than that of a blind hole.

Figure 4:
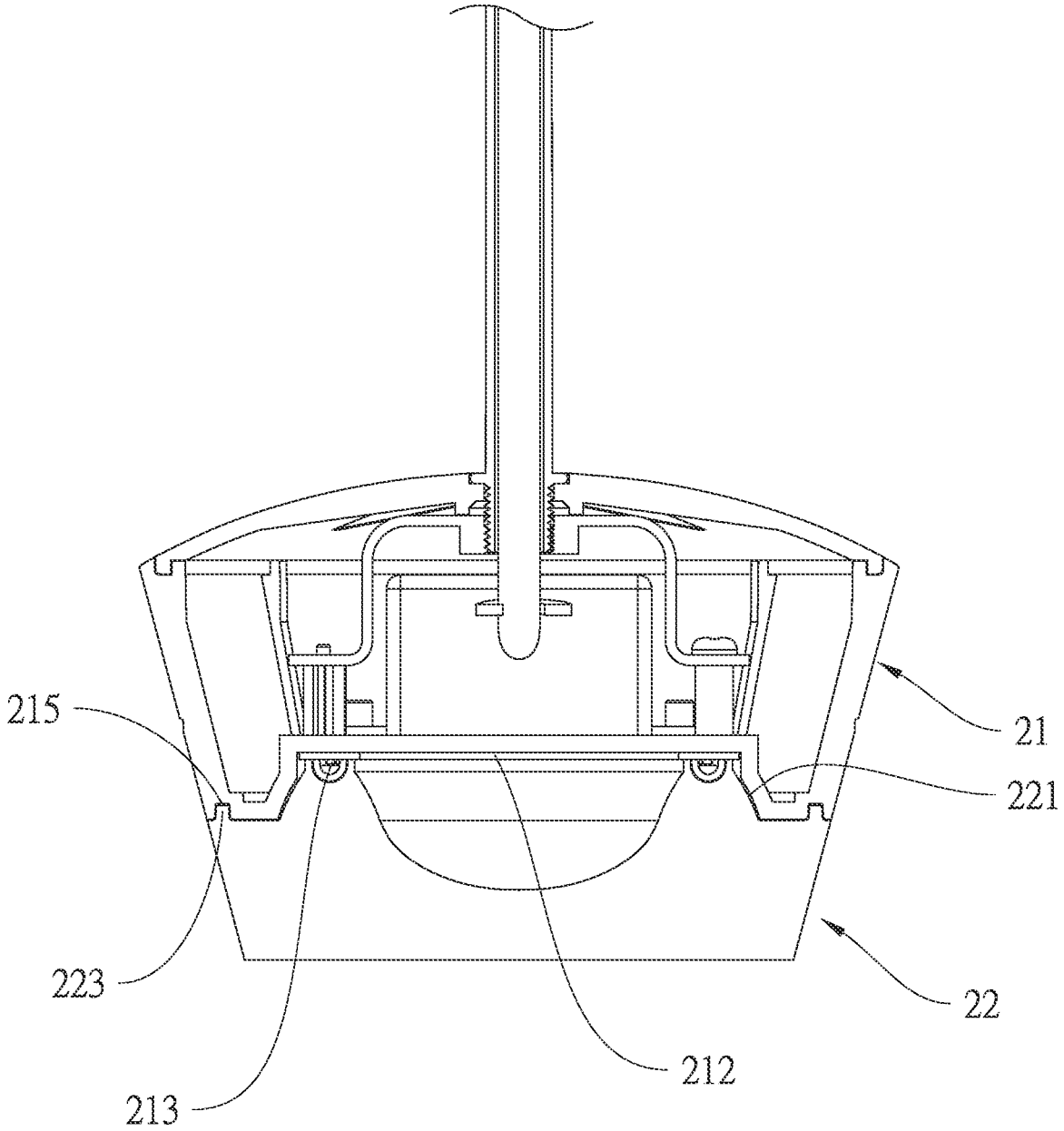
FIG. 4 is a side view illustrating the combined form of FIG. 3.

The lamp holder 21 and the lampshade 22 are combined with each other through the first limiting member 215 and the second limiting member 223 to form a structure as shown in FIG. 4. In this way, it is not only limit the relative position between the lamp holder 21 and the lampshade 22, but also ensure the light of the light-emitting elements 213 on the lamp holder 21 can emit toward the light incident portion 221 of the lampshade 22. In addition, the light incident portion 221 of the lampshade 22 can be attached directly to the circuit board 212 to prevent the light of the light-emitting elements 213 from leaking between the lampshade 22 and the lamp holder 21, and the light is transmitted inside the lampshade 22 and emitted concentratedly. In this embodiment, the first limiting member 215 and the second limiting member 223 are combined in a manner of grooves and bumps corresponding to each other, so that the lamp holder 21 and the lampshade 22 can align and combine accurately. In some embodiments, the lamp holder 21 and the lampshade 22 can also be combined through the first limiting member 215 and the second limiting member 223 by means of magnetic attraction, so that the lampshade 22 can be mount on or remove from the lamp holder 21 easily. The number of the first limiting member 215 and the second limiting member 223 may also be plural and arranged at intervals to strengthen the bonding force between the lamp holder 21 and the lampshade 22.

In some embodiments, the diffuser 23 is a frosted structure or a hairline structure formed directly on the surface of the accommodating groove 222 facing the light-emitting elements 213. In this way, in addition to the light diffusion effect, another processing method is also provided, which has the effect of simplifying the assembly process.

Figure 5:
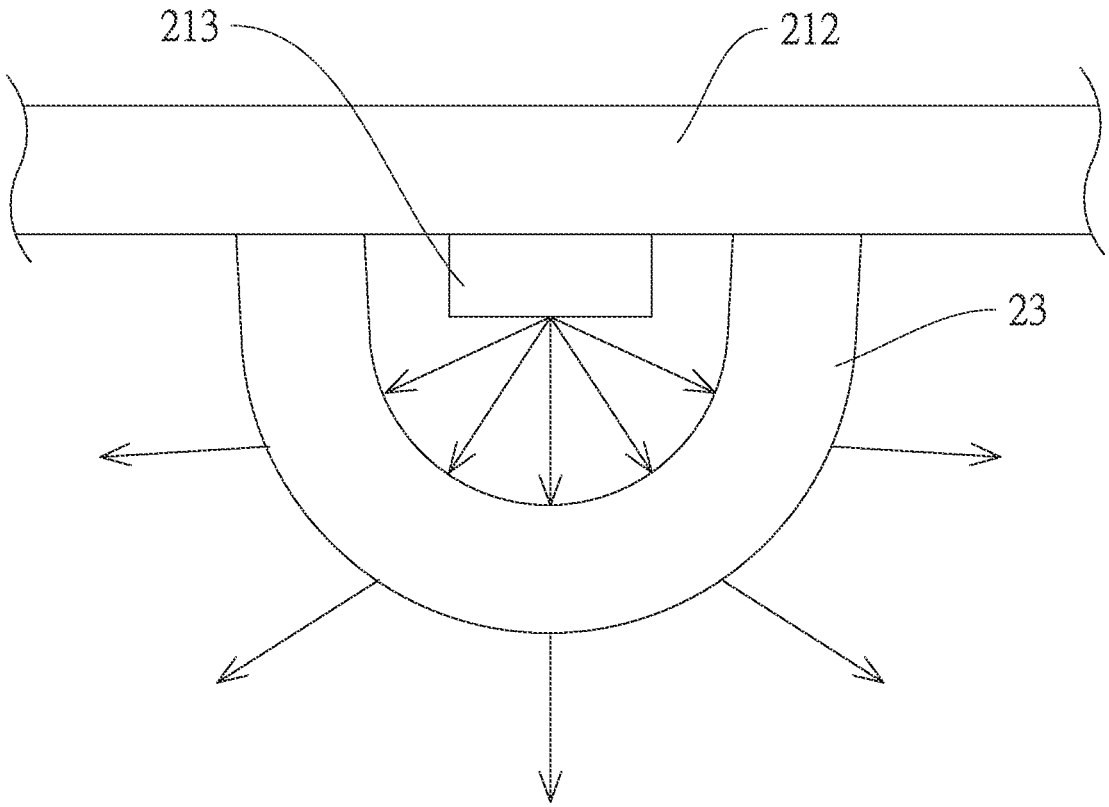
FIG. 5 is a schematic diagram illustrating the diffusion effect of a diffuser on a light-emitting element.
Figure 10:
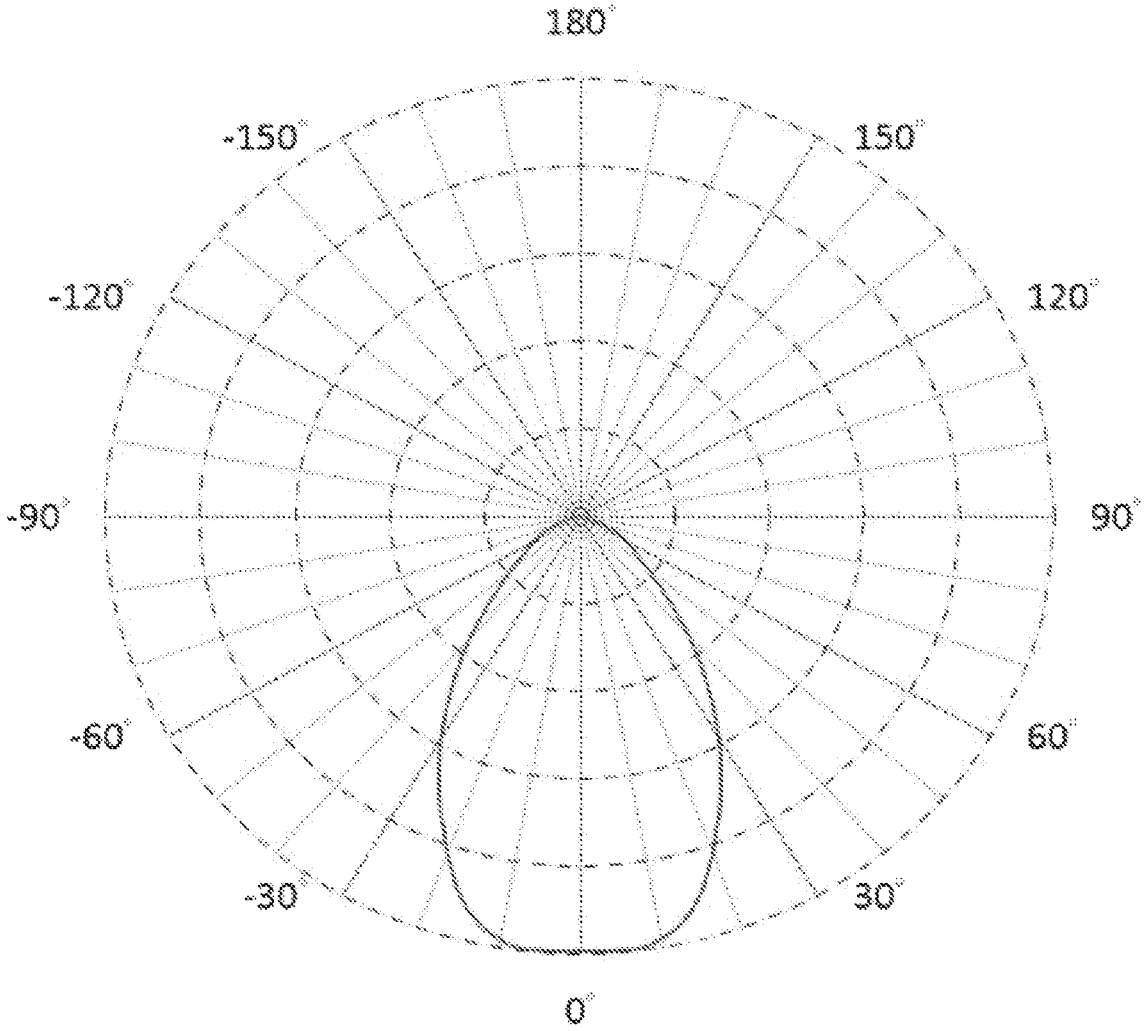
FIG. 10 is a light distribution curve diagram of the lamp according to the first embodiment of this invention.

Referring to FIG. 3, the accommodating groove 222 is an annular groove, and the light-emitting elements 213 are plural and arranged along the accommodating groove 222. The diffuser 23 has an annular curved surface structure that matches the shape of the accommodating groove 222, so that the distance between the diffuser 23 and each of the light-emitting members 213 is approximately the same. As shown in FIG. 5, the accommodating groove 222 and the diffuser 23 are designed with a curved surface shape to maintain an equal distance between the diffuser 23 and each of the light-emitting members 213 in at least a cross section, which ensure the light emitted by each of the light-emitting elements 213 enters the diffuser 23 as vertically as possible. Therefore, the light emitted from the light-emitting elements 213 to various angles can be diffused equidistantly so as to reduce the loss caused by light reflection. It has a better diffusion effect as compared with a flat diffuser. In addition, the use of the diffuser 23 with the lampshade 22 can perform an additive diffusion effect and reduce the light spots or glare. In other words, the diffusion effect of this present invention is much better than the diffusion effect performed by using the lampshade 22 alone. Referring to FIG. 10, the light distribution curve of this embodiment is more smooth, it means that the light emitted by the lamp of this invention is relatively soft, and the problem of dazzling viewing experience has been solved in evidence.

Figure 6:
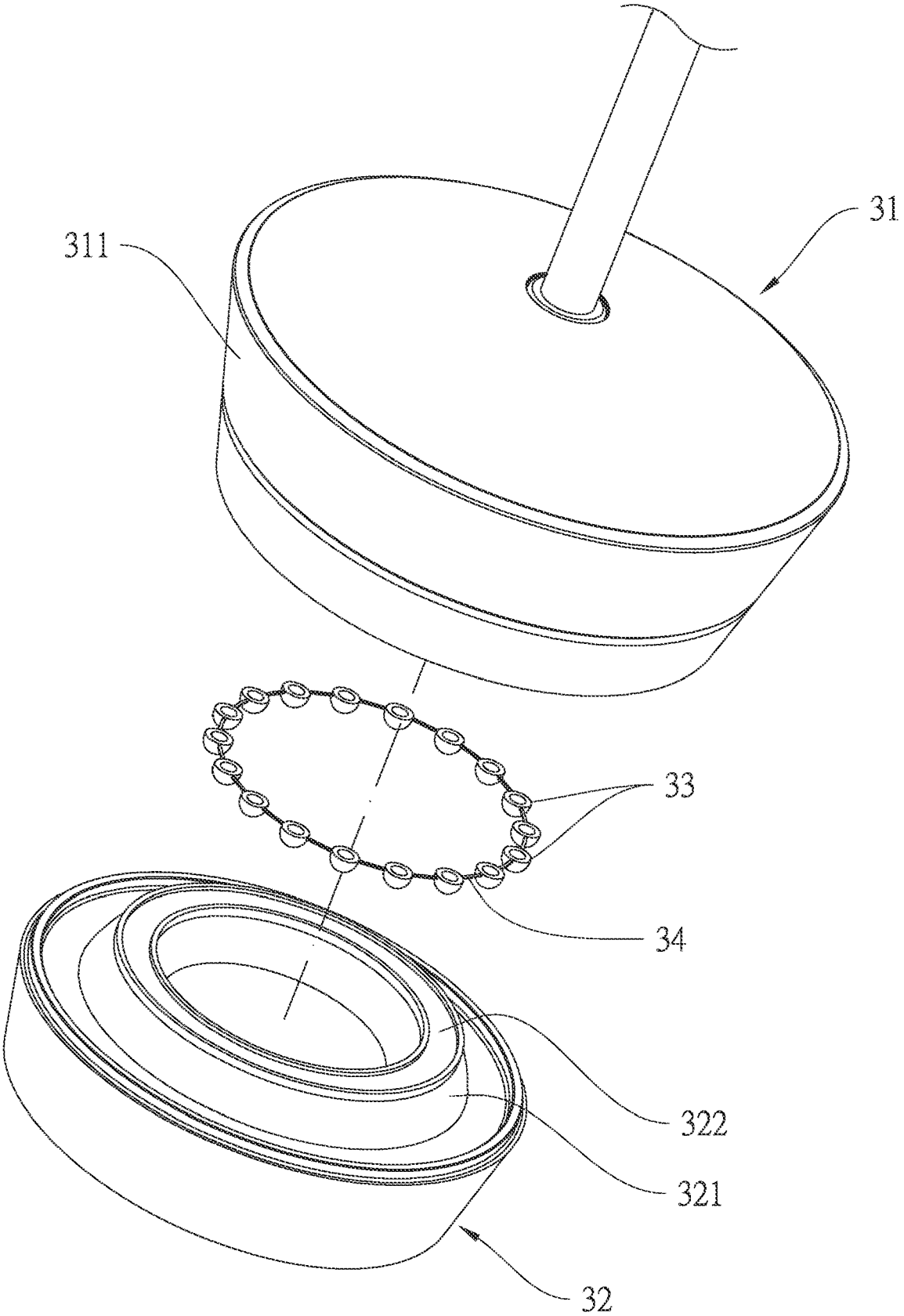
FIG. 6 is a three-dimensional exploded view of a lamp according to a second embodiment of this invention.
Figure 7:
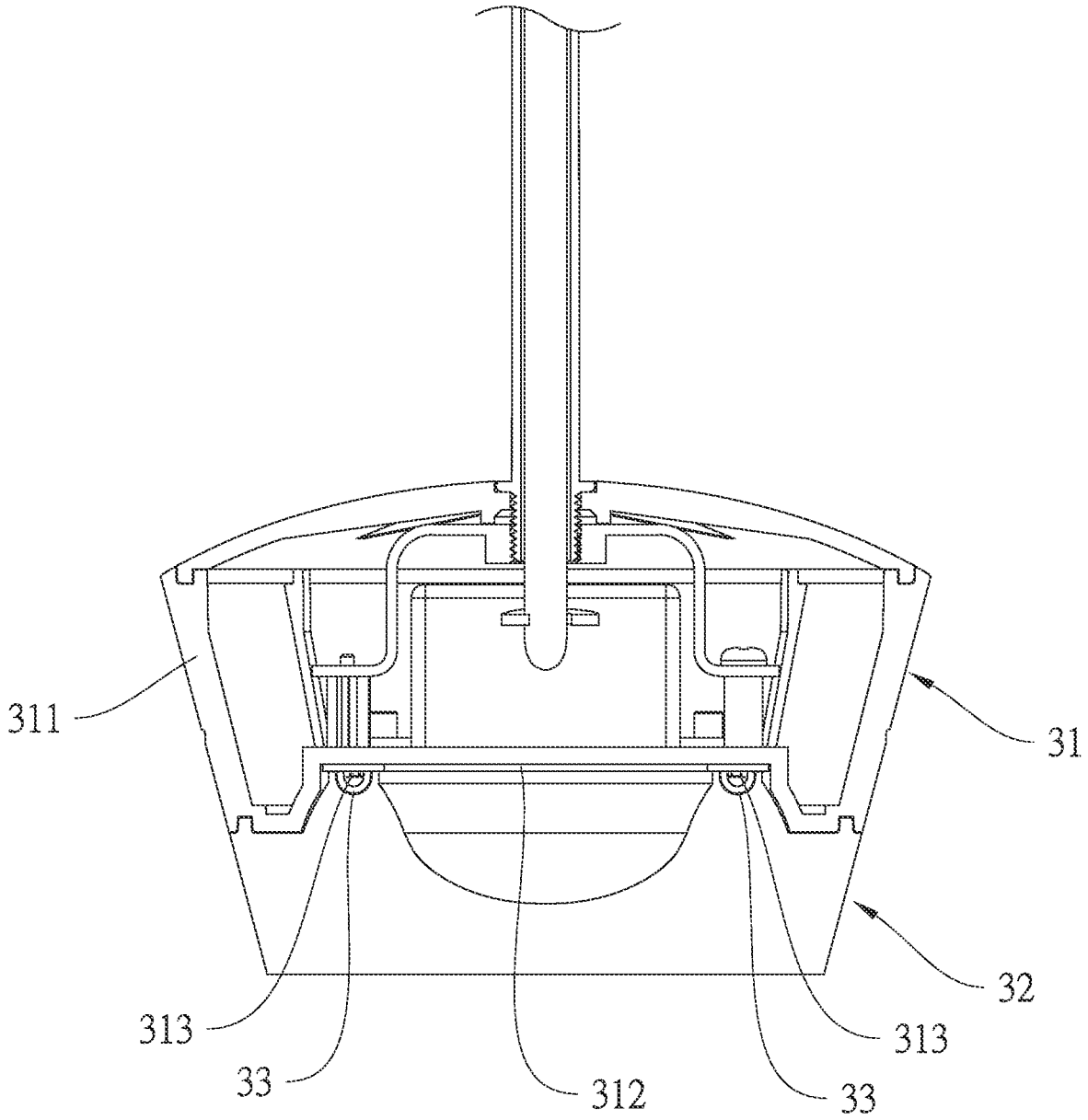
FIG. 7 is a side view illustrating the combined form of FIG. 6.

Referring to FIG. 6 and FIG. 7, the second preferred embodiment of the lamp of the present invention includes a lamp holder 31, a lampshade 32 combined with the lamp holder 31, and a plurality of diffusers 33. The lamp holder 31 includes a base 311, a circuit board 312 arranged on the base 311, and a plurality of light-emitting elements 313 arranged on the circuit board 312 at intervals.

Figure 8:
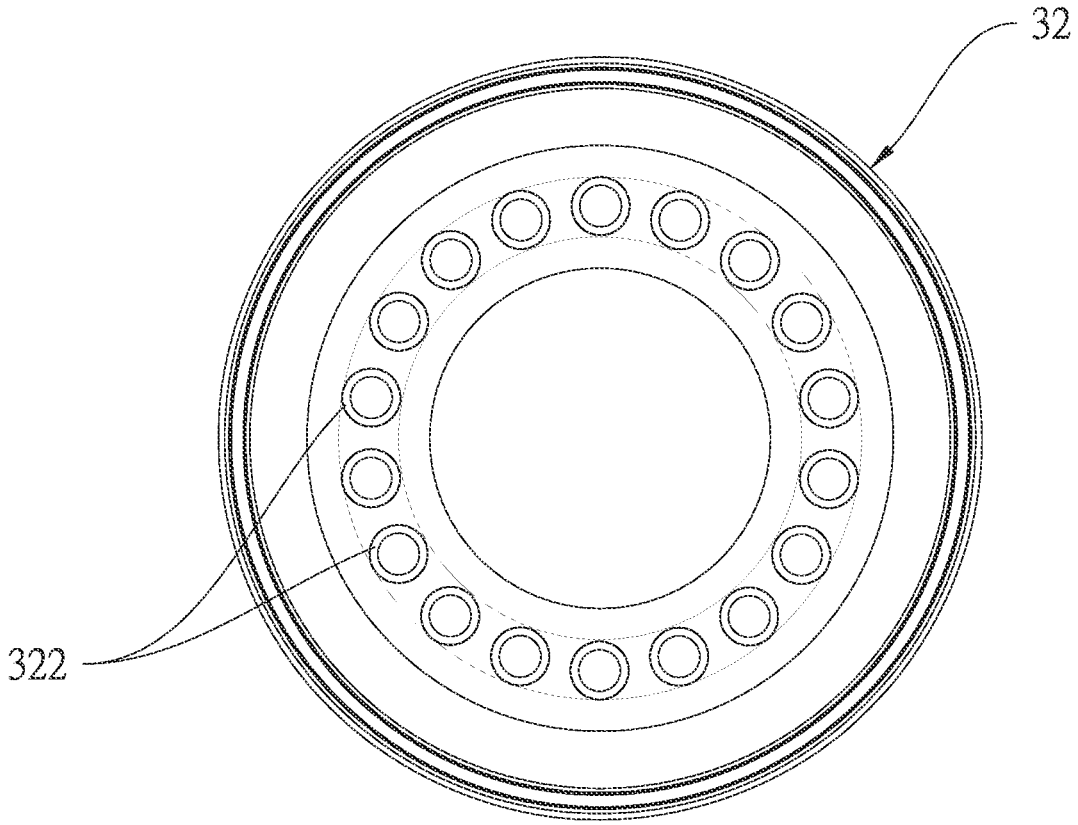
FIG. 8 is a partial plan view illustrating another structure of a accommodating groove of a lampshade according to the second preferred embodiment.

In this embodiment, the lampshade 32 includes a light incident portion 321, the light incident portion 321 has a accommodating groove 322 for receiving the light-emitting elements 313, and the diffusers 33 are disposed in the accommodating groove 322. Wherein, each diffuser 33 is hemispherical, and the position of the diffusers 33 in the accommodating groove 322 are corresponding to the light-emitting elements 313 respectively. In order to ensure that the diffuser 33 can correspond to the light-emitting member 313 reliably, a connecting member 34 may be provided between two adjacent diffusers 33 to maintain the distance between the two diffusers 33. This prevents the diffusers 33 from shifting and colliding with the corresponding light-emitting elements 313. In some embodiments, the diffuser 33 can also be fixed in the accommodating groove 322, and the connecting member 34 is not necessary. In addition, as shown in FIG. 8, in some embodiments, the accommodating grooves 322 are plural and arranged in a circle at intervals, and each one of the light-emitting elements 313 is disposed in the corresponding accommodating grooves 322. Moreover, each accommodating groove 322 is hemispherical, so the diffusers 33 with the same shape can be fitted in and positioned separately in the accommodating grooves 322, so as to avoid the displacement of the diffusers 33. In this embodiment, each one of the diffusers 33 is kept equidistant with the corresponding light-emitting elements 313 in any cross-section, which can ensure the light emitted by each one of the light-emitting elements 313 enters the corresponding diffuser 33 as vertically as possible, so that the light emitted from the light-emitting elements 313 toward various angles can be diffused equidistantly to reduce the loss caused by light reflection. Furthermore, each one of the diffusers 33 can be a frosted structure or a hairline structure formed directly on the surface of the corresponding accommodating grooves 322 facing the light-emitting element 313.

Through the above design, each diffuser 33 can cover the corresponding light emitting element 313 completely, which can avoid light leakage and perform a good diffusion effect of the light emitted by the light-emitting element 313. For the lampshade 32 made of transparent material, it also has the effect of reducing the generation of light spots or glare, thereby improving the light uniformity of the lamp of this present invention.

Figure 9:
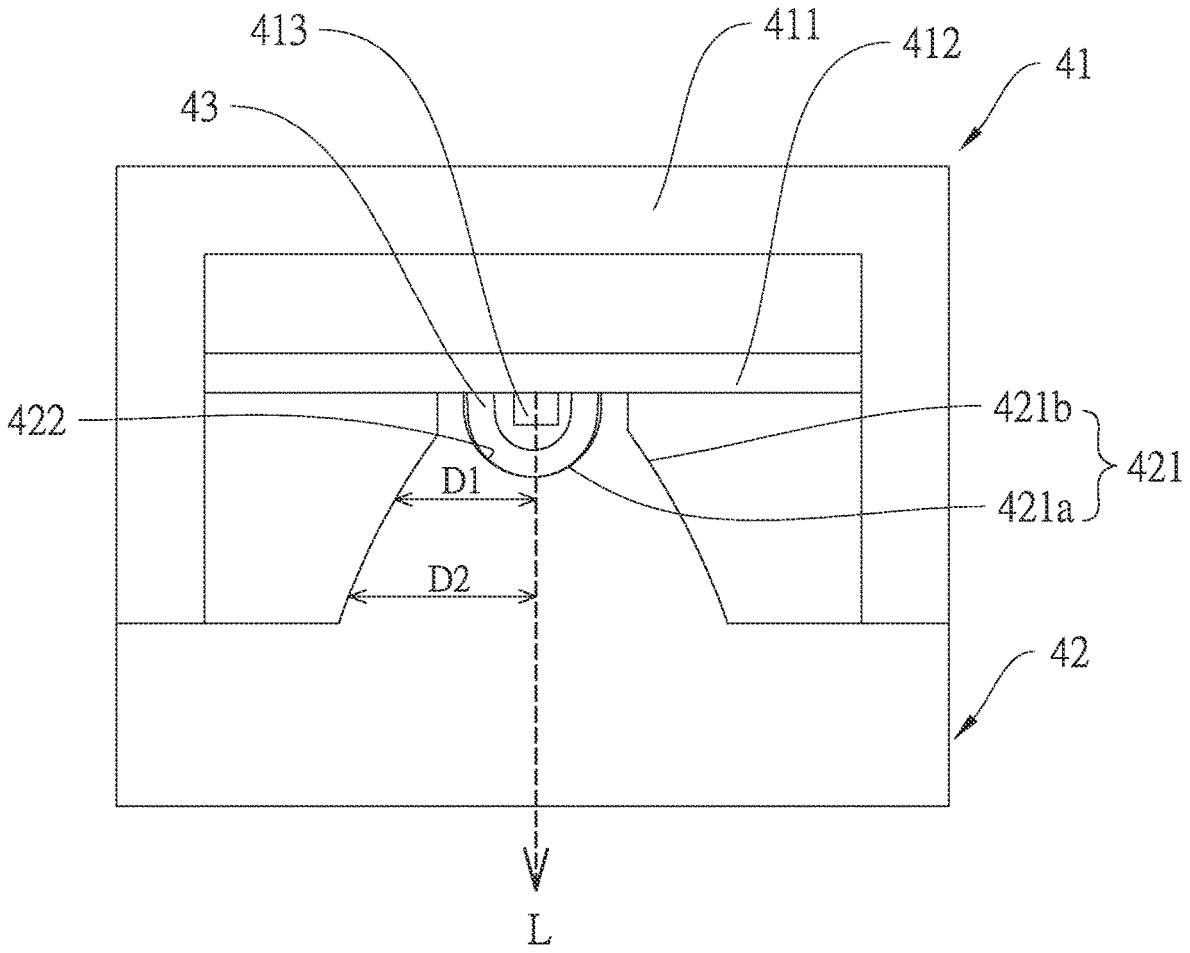
FIG. 9 is a schematic diagram according to the third embodiment of this invention.

Referring to FIG. 9, a third preferred embodiment of the lamp of the present invention includes a lamp holder 41, a lampshade 42 combined with the lamp holder 41, and a diffuser 43. Wherein the diffuser 43 is placed between the lamp holder 41 and the lampshade 42. In this embodiment, the lamp holder 41 includes a base 411, a circuit board 412 disposed on the base 411, and a light-emitting element 413 disposed on the circuit board 412. The lampshade 42 includes a light incident portion 421, and the light incident portion 421 has at least one accommodating groove 422 for receiving the light-emitting element 413 and the diffuser 43.

It should be noted that, in this embodiment, the light incident portion 421 has a light incident surface 421*a* facing the light-emitting element 413, and a reflective surface 421*b* disposed around the light incident surface 421*a*. Wherein, the reflective surface 421*b* is used to reflect the light entering the light incident portion 421 and proceed the light toward the collimation direction. Preferably, the angle of the light reflected from the reflective surface 421*b* is less than 30 degrees. In more detail, the reflective surface 421*b* extends along the light emitting direction of the optical axis L of the light-emitting element 413, and a distance from the reflective surface 421*b* to the optical axis L gradually increases from a near end to a rear end of the reflective surface 421*b* relative to the light-emitting element 413. For example, in this embodiment, the light incident portion 421 is designed in a bell-shaped solid structure, and two points are randomly selected on the optical axis L and extend toward the reflecting surface 421*b* to obtain a first distance D1 and a second distance D2. Wherein the second distance D2 which is farther from the light emitting element 413 is greater than the first distance D1 which is closer to the light emitting element 413. In this way, this embodiment can achieve the effect of light concentration by directing the light entering the light incident portion 421 toward the collimation direction, and the diffuser 43 of this embodiment can solve the glare caused by the concentrated light angle. In this embodiment, one light-emitting element is taken as an example to illustrate the situation which the light from the light-emitting element is directed to the collimation direction. A plurality of light-emitting elements are arranged in a circle as described in the first embodiment, the annular light incident portion can also be used to guide the light of the light-emitting elements to the collimation direction to achieve the effect of light concentration.

In summary, the lamp of this present invention can maintain a better diffusion distance between the diffuser and the light-emitting element through the structure and arrangement of the diffuser and the accommodating groove. It can perform a better diffusion effect, reduce the generation of light spots or glare and improve the light uniformity of the lamp and the comfort of use.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

What is claimed is:

1. A lamp comprising:

a lamp holder, including a base, a circuit board arranged on the base, and at least one light-emitting element arranged on the circuit board;

a lampshade combined with the lamp holder, wherein the lampshade has a light incident portion, a light emitting portion and an accommodating portion which is closer to the light incident portion than to the light emitting portion, and the at least one light-emitting element emits light toward the light incident portion; and at least one diffuser, which covers the at least one light-emitting element;

wherein the at least one diffuser is accommodated in the accommodating portion;

wherein the light incident portion of the lampshade can be attached directly to the circuit board;

wherein the base of the lamp holder has at least one first limiting member, and the lampshade has at least one second limiting member corresponding to the first limiting member;

wherein the at least one second limiting member of the lampshade is disposed outer of the light incident portion, the base of the lamp holder has an annular wall area surrounding the circuit board and relative protruding from the circuit board, and the at least one first limiting member is disposed on the annular wall area.

2. The lamp as claimed in claim 1, wherein the accommodating portion has at least one accommodating groove disposed at the light incident portion for accommodating the at least one light-emitting element, and the at least one diffuser is disposed in the accommodating groove.

3. The lamp as claimed in claim 1, wherein the at least one diffuser is a frosted structure or a hairline structure formed on a surface of the light incident portion facing the at least one light-emitting element.

4. The lamp as claimed in claim 1, wherein the at least one diffuser is an independent element integrated with the accommodating portion and located between the light incident portion of the lampshade and the at least one light-emitting element.

5. The lamp as claimed in claim 1, wherein the at least one diffuser is an independent element located in the accommodating portion and wrapped in the lampshade.

6. The lamp as claimed in claim 1, wherein the base of the lamp holder and the lampshade are magnetically attracted to each other via the at least one first limiting member and the at least one second limiting member.

7. The lamp as claimed in claim 2, wherein the number of the light-emitting elements is plural, the accommodating groove is an annular groove, and the light-emitting elements are arranged along the accommodating groove.

8. The lamp as claimed in claim 7, wherein the shape of the at least one diffuser is a annular curved surface structure that matches the shape of the accommodating groove.

9. The lamp as claimed in claim 1, wherein the light-incident portion has a light-incident surface facing the at least one light-emitting element, and a reflective surface surrounding the light-incident surface, and the reflective surface extends along the light-emitting direction of the optical axis of the light-emitting element, and a distance from the reflective surface to the optical axis gradually increases from a near end to a rear end of the reflective surface relative to the at least one light-emitting element.

10. The lamp as claimed in claim 1, wherein the lampshade has a first end surface, and a second end surface opposite to the first end surface, wherein the first end surface has a groove extending toward the second end surface, and the accommodating portion is disposed around the groove.

11. The lamp as claimed in claim 10, wherein the groove is a blind hole.

12. The lamp as claimed in claim 10, wherein the groove is a through hole.

13. A lamp comprising:

a lamp holder, including a base, a circuit board arranged on the base, and at least one light-emitting element arranged on the circuit board;

a lampshade combined with the lamp holder, wherein the lampshade has a light incident portion, a light emitting portion and an accommodating portion which is closer to the light incident portion than to the light emitting portion, and the at least one light-emitting element emits light toward the light incident portion; and at least one diffuser, which covers the at least one light-emitting element;

wherein the at least one diffuser is accommodated in the accommodating portion;

wherein the light incident portion of the lampshade can be attached directly to the circuit board;

wherein the number of the light-emitting element is plural, the accommodating portion comprising a plurality of hemispherical grooves, and each one of the light-emitting elements is disposed in the corresponding hemispherical groove.

14. The lamp as claimed in claim 13, wherein the number of the diffuser is plural, and each one of the diffuser is hemispherical shape, and each one of the light-emitting element is disposed in the corresponding diffuser.

15. The lamp as claimed in claim 14, wherein at least one connecting member is provided between the two adjacent diffusers.

* * * * *